United States Patent [19]

Cooper et al.

[11] Patent Number: 4,670,071

[45] Date of Patent: Jun. 2, 1987

[54] METHOD OF FORMING A WATERPROOF ROOF

[75] Inventors: Gregory R. Cooper, Swanwick; Robert J. Pragnell, Cheltenham, both of England

[73] Assignee: Coal Industry (Patents) Limited, England

[21] Appl. No.: 664,002

[22] Filed: Oct. 23, 1984

[51] Int. Cl.[4] ..... E04B 2/00; B32B 31/12; C09J 3/30; A61F 13/20

[52] U.S. Cl. ..... 156/71; 156/82; 156/247; 156/337; 428/40; 428/137; 428/291

[58] Field of Search ..... 52/199, 408; 428/40, 428/188, 141, 138, 41, 137, 489, 142, 291, 343; 156/74, 82, 71, 249, 289, 337, 247, 155, 182, 309.6, 297

[56] References Cited

U.S. PATENT DOCUMENTS

| | | | |
|---|---|---|---|
| 4,021,981 | 5/1977 | Van Wagoner | 150/71 |
| 4,055,453 | 10/1977 | Tajima et al. | 428/41 |
| 4,236,951 | 12/1980 | Krahma et al. | 156/71 |
| 4,357,377 | 11/1982 | Yamamoto | 428/141 |
| 4,397,126 | 8/1983 | Nelson | 52/199 |
| 4,443,993 | 4/1984 | Fujiki et al. | 156/71 |
| 4,490,952 | 1/1985 | Winston | 52/199 |
| 4,492,064 | 1/1985 | Bynoe | 52/408 |
| 4,565,724 | 1/1986 | Smits | 428/138 |

FOREIGN PATENT DOCUMENTS 1326894 8/1973 United Kingdom .

*Primary Examiner*—Donald Czaja
*Assistant Examiner*—Louis Falasco
*Attorney, Agent, or Firm*—Stevens, Davis, Miller & Mosher

[57] ABSTRACT

A roofing method comprises applying to a roof deck a self-adhesive sheet comprising an adhesive and waterproofing layer of bituminous compound so that the sheet adheres to the deck over an area of 10–50% of the total sheet area and water vapor passing through the deck may escape laterally; rendering the upper surface of the sheet adhesive, for example by torching; optionally applying insulation board and a further self-adhesive sheet, and applying a final waterproofing sheet. The use of hot bitumen is completely avoided, the formation of waterproof and insulated roofs is simplified and economies are offered.

7 Claims, 2 Drawing Figures

METHOD OF FORMING A WATERPROOF ROOF

Figure 1:
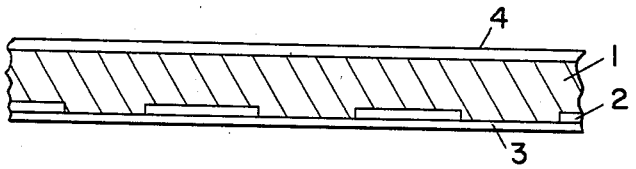

This invention concerns improvements in roofing, and more especially concerns a method of forming a roof waterproofing system.

Conventional methods of forming a built-up flat roof, on top of a roof deck, involve the application of many individual layers of membrane bonded in hot molten bitumen. A bitumen heater has to be used to melt solid blocks of bitumen and the heater has to be taken onto the top of the building or containers of molten bitumen transported from ground level to the roof. The fumes from bitumen heaters are often found to be offensive and the molten bitumen may be a health or safety hazard. There are serious risks of under- or over-heating the bitumen and failures of conventional built-up roofs because of inadequate bonding of layers, cracking due to movement, etc. are not uncommon. A conventional built-up roof may require three or four layers of molten bitumen to be spread on the respective substrate, and four of five other layers of reinforcement or other material.

Preformed sheeting comprising a support sheet of plastics, a metal foil, roofing felt or the like, with a bonded waterproofing layer of self-adhesive bituminous compound, have been marketed. Although the major usage has been in waterproofing foundations and below-ground structures, some have been proposed for and used as a top layer or other layer in a built-up roof.

Since the energy crises of the 1970's, much greater attention has been paid to insulating buildings. In many cases problems do arise because the temperature differences between the "outside" and "inside" of the insulating layer cause condensation of water vapour permeating the insulating layer. Inadequate venting of the insulation, aggravated by substantially totally impermeable waterproof built-up roofs, can lead to rot, decay and degradation of the building structure, and/or bubbling and cracking of the bitumen layers.

It is an aim of the present invention to provide a reliable roof waterproofing system with a simpler application of materials and also to completely avoid the use of hot bitumen.

The present invention provides a method of forming a waterproof roof on a roof deck, comprising the steps of (i) applying to the deck, a self-adhesive sheet comprising a pressure-sensitive, adhesive and waterproofing layer of a bituminous compound so that the sheet adheres to the deck over an area of 10–50% of the total sheet area, and water vapour passing through said deck may escape laterally;

(ii) rendering the upper surface of said sheet adhesive;

(iii) optionally applying to said adhesive upper surface of said sheet, a layer of substantially rigid and substantially non-compressible insulation and causing said insulation to adhere to said upper surface, and applying to the upper surface of said insulation a further self-adhesive sheet as defined in step (i) and rendering the upper surface of said further sheet adhesive; and (iv) applying to said adhesive surface of the sheet or said further sheet a final waterproofing sheet.

The self-adhesive sheet and the further self-adhesive sheet used in the invention may be identical or may differ from one another in construction. The sheet may consist of a single layer of pressure-sensitive adhesive and waterproofing bituminous compound, or two such layers separated by a core layer. The bituminous compound is suitably a tacky compounded bitumen. The bitumen may be a straight or, preferably, blown bitumen, compounded with a polymer and optionally other components including tackifiers, extenders, fillers, pigments and oils to give a material which is waterproof and will adhere strongly to materials such as primed concrete when moderate pressure, such as can be applied manually, is applied. Preferably, the polymer is a natural or synthetic rubber. Each layer of compound may be 0.5 to 5 mm thick. Suitable tacky compounded bitumens are known in the building and construction products industry.

The self-adhesive sheet comprises, in one embodiment, an integral apertured sheet adhering to one face of the bituminous compound, and having continuous or discontinuous apertures of 10–50% of the area of the self-adhesive sheet. The apertured sheet is substantially impervious to the bituminous compound except where there is an aperture, and the sheet is capable of bonding to a substrate in the area of the apertures. Although the apertured sheet may be a sheet of plastics film such as polyolefin, PVC or polyester, paper such as kraft paper or building paper, metal such as aluminium or copper foil or sheet, it is preferably a woven or especially a non-woven fabric of natural or, preferably, synthetic fibre, preferably a polymer or glass fibre non-woven fabric. The apertures are suitably regularly spaced and extend across the full area of the sheet; they may conveniently be round, rectangular or rhombic in shape and may be between 30 and 200 mm across. If the apertured sheet is in strip form the strips are applied parallel to the length of the length of the sheeting, and are suitably 25 to 250 mm wide, regularly spaced and leaving apertures or exposed bituminous compound in widths of suitably 30 to 200 mm. It will also be understood that the layer of bituminous compound adhering to the apertured sheet flows through the apertures during manufacture and can thus bond the laminated sheeting to the substrate under moderate pressure. The apertured sheet may conveniently be 0.020 to 3 mm thick, preferably 0.05 to 1.5 mm thick. If permeation of bituminous compound into a fabric sheet is problematical, the fabric may include, or be faced with, a polymeric film.

The face of the self-adhesive sheet having the apertured sheet desirably carries a release sheet which may be easily stripped therefrom to permit the self-adhesive sheet to be applied to the roof deck of the insulation. Such release sheets are well known and may conveniently be a silicone-treated paper or plastics film. The upper face of the self-adhesive sheet also requires a facing sheet to prevent it sticking to itself, and although such facing sheet may be a release sheet, it is preferred that it is a thin low-melting polymer film such as a polyethylene or polypropylene film, suitably of a thickness of 0.5 to 15 microns. Such a facing sheet may be "torched" using a gas flame or hot air, so as to melt it and expose the upper self-adhesive surface preparatory for the application of a further material. A "torching" process avoids the disposal of a further area of release sheet, permits the use of a less costly sheet and will improve adhesion of the roofing system, especially under colder climatic conditions.

The invention also provides a self-adhesive sheet comprising a pressure-sensitive, adhesive and waterproofing layer of a bituminous compound having an apertured sheet adhering to one face of the layer, said apertured sheet having continuous or discontinuous apertures of 10–50% of the area of the sheet, said apertured sheet being substantially impervious to the bituminous compound except where there is an aperture, and having on the other face of the layer of bituminous compound, a facing sheet removable to render said other face self-adhesive, the sheet being adhesive in the areas of said apertures.

Certain other advantages flow from the use of a polymer film facing sheet, compared to a release sheet. If a self-adhesive sheet has release sheets on both faces, it exhibits unsightly and possibly disadvantageous creasing when rolled up. Such a problem can be overcome, but only by the use of expensive crepe or corrugated release sheets on both faces, which can also make the roll awkward to handle. The use of film facing sheets permits a conventional release sheet to be used on the apertured sheet face, thus reducing the cost.

Furthermore, a film facing sheet permits easily limited and accurate exposure of a self-adhesive top surface. Premature exposure, for example by stripping a complete sheet of release paper, can cause problems with contamination or in working on a building or construction site.

The self-adhesive sheets are preferably made up in rolls; for most uses where the rolls have to be handled and applied manually, suitable widths are 0.8 to 1.2 m. The self-adhesive sheets used in the method described previously are believed to be novel and accordingly form part of the present invention.

As mentioned above, the self-adhesive sheet may include a central core in the bituminous compound. Such a core may be a polymeric film, for example a polyolefin such as a polyethylene, polypropylene or copolymer thereof, or a polyvinyl chloride or polyester film, or may be a woven or non-woven glass fibre or polyester fabric, especially where resistance to puncture is required. The core may be 0.02 to 2 mm thick.

The roof deck to which the novel roofing system may be applied may be a new or old deck of any substantially rigid construction. In the case of more or less porous upper deck surfaces, for example concrete, screeded wood wool slab, roofing felt, asphalt, and various timbers including chipboard, it is desirable to prime the surface before applying the sheets of the invention. It is preferred to use a solvent-based bituminous primer, especially a solution of a polymer-modified bitumen. In the case of a non-porous deck such as metal, primer may not be necessary. A currently favoured industrial roof deck is corrugated or troughed metal, and since adequate partial bonding may be achieved by adherence of the self-adhesive sheet to the uppermost surfaces of the deck and hence water vapour may escape by means of the troughs, a further embodiment of the self-adhesive sheet comprises the layer of bituminous compound provided with a strippable release sheet, a central core layer of puncture-resistant fabric and a further layer of bituminous compound. The outer face of the further layer of bituminous compound may carry another strippable release sheet or, preferably, a thin film of low-melting polymer as described above.

The self-adhesive sheet in contact with the roof deck may provide a "vapour-check" or a "vapour-barrier" function, and different thicknesses of bituminous compound layers may be specified for the different functions. In particular, for roofs above high-humidity areas, for example a school kitchen, it would be advisable to use a "vapour-barrier" and it is preferred to use a sheet with a core layer of plastics film.

A layer of insulation may be incorporated in the roof, according to requirements, and this is suitably a substantially rigid foamed plastics material. In conventional built-up roofs using molten bitumen, a heat-resistant material such as foamed polyurethane board is used. However, the present invention provides the considerable advantage that expanded polystyrene may be bonded to the adhesive upper surface of the self-adhesive sheet without damage, even when torching is used to remove upper films of protective films of self-adhesive sheets. Expanded polystyrene is considerably cheaper than other foamed plastics insulation boards. However, the invention may be used with all conventional insulation materials. If adhesion is not adequate, perhaps because of some surface treatment of the insulation, a coat of primer may be applied to the insulation.

When insulation is incorporated, a further self-adhesive sheet is applied over it, and this also has to provide for the lateral escape of water vapour. Accordingly, with all normal forms of insulation, the sheet should incorporate the integral apertured sheet.

A final waterproofing sheet is applied as the top layer of the roof. This may be any environmentally stable and protective waterproofing sheet, and bitumen laminates or impregnated felts of known type may be considered if they demonstrate adequate properties. The final sheet may incorporate a solar-reflective upper surface, such as aluminium foil or mineral chippings, or such a surface may be applied after the final sheet is laid. In accordance with good practice, the roof is preferably laid with a slope to prevent standing water threon, and also a good standard of care is to be taken to ensure adequate bonding in the overlaps of the final sheet.

The present invention offers a new and economically competitive roofing system which permits reliable waterproofing to the roof if it is necessary or desirable to form the waterproof roof in stages. Prior proposals using forms of self-adhesive sheeting in roofing applications have either still necessitated the use of molten bitumen at some stage in forming the roof or have not permitted any escape of water vapour, or have been expensive. The novel sheets of this invention may be considered as cold bonding layers in addition to waterproofing and ventilating the roof structure. By preforming the sheets off-site in a factory, economies and reliability of waterproofing may be expected. The invention thus provides a venting, waterproofing and bonding layer in one sheet which has not previously been possible with systems on the market, and although methods of providing partial bonding have been marketed, other sheets and/or layers have been required to provide waterproofing and bonding for other roof components. Conventional manufacturing methods may be used.

Other benefits arise from the method of the invention. By adhering the self-adhesive sheet to a limited area of the contact area with the roof deck, the sheet is not unduly strained by movement of the roof deck, of insulation board, by movement of expansion joints or the like.

The present invention will now be described by way of example only.

EXAMPLE 1

A self-adhesive sheet providing a vapour-check on top of a roof comprises a 1 mm thick glass fibre mat with 25–30% of its area formed by punched apertures of 5 cm diameter. A layer of tacky waterproofing rubber-modified bitumen overlies the glass fibre mat in a thickness of 1 mm, and extends through the apertures. The surface of the mat with partial exposed tacky bitumen is protected by a siliconised paper release sheet, and the other face carries a 9 micron polyethylene film.

The self-adhesive sheet is applied to a primed concrete flat roof by unrolling and stripping off the release sheet. A conventional "cap sheet", suitably an aluminium-faced bitumen laminate, or a layer of polystyrene board insulation, is then applied after "torching" the upper surface of the applied sheeting using a conventional gas flame, to render it adhesive. If insulation is used, a further sheet as described in Example 3 below is applied thereto before the cap sheet.

EXAMPLE 2

Onto a troughed metal flat roof deck is applied a self-adhesive sheet comprising a 100 g/m$^2$ polyester non-woven mat core, coated on each face with a 1 mm of tacky rubber-modified bitumen. The face of the sheet applied to the deck is protected before application by a siliconised release sheet and the upper surface is protected by a 10 micron polyethylene film. The polyethylene film is torched off to expose a self-adhesive surface and a cap sheet, or an insulation sheet, further sheet and cap sheet, is applied to form a totally waterproof roof.

EXAMPLE 3

A roof deck which is of a concrete screeded wood wool slab construction is primed with a spirit-based polymer-modified bitumen primer. Onto the primed surface is unrolled, by stripping off the release sheet, a roll of self-adhesive sheeting having a core film of 0.1 mm polyethylene film coated on each side with 1 mm of tacky synthetic rubber-modified and oil-extended bitumen. The face of the sheeting carrying the release sheet carries a 1 mm thick glass fibre mat having 30% apertures, the tacky bitumen extending through the apertures to contact the release sheet. The other face of the sheeting is protected by a 9 micron polyethylene film.

After the sheeting is laid on the roof deck, the top surface film of polyethylene is torched off and 50 mm thick slabs of polystyrene insulation are applied. Onto the top surface of the insulation is unrolled an identical self-adhesive sheeting. The top polyethylene film is also torched off, and an aluminium-faced bitumen sandwich cap sheet is applied and adheres firmly. The lap bonds of the cap sheet are torch-bonded and a particularly reliable waterproof roof is obtained. There does not appear to be any degradation of the insulation by water vapour condensation since the vapour is vented to the atmosphere.

Figure 2:
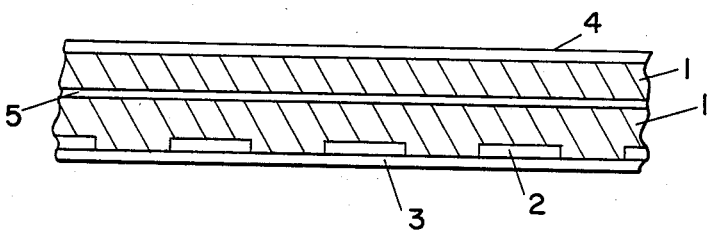

The self adhesive sheet as discussed in examples 1 and 3 above is illustrated in FIGS. 1 and 2 both of which are sectional elevational views.

FIG. 1 illustrates a sheet in which a layer 1 of tacky rubber-modified bitumen has on one face a glass fibre mat 2 having apertures through which the bitumen extends. A protective siliconized release sheet 3 overlies the exposed areas of bitumen and can easily be stripped off to permit the sheet to be applied to a substrate. The other face of bitumen layer 1 carries a thin easily-fusible film 4 of low molecular weight polyethylene. This film can be torched off when desired to render the top surface of the sheet adhesive.

FIG. 2 illustrates a modification of the sheet of FIG. 1, in which a core layer 5 of polyethylene film is coated on each side with the tacky bitumen 1.

We claim:

1. A method of forming a waterproof roof on a roof deck, comprising the steps of (i) applying to the deck, a self-adhesive sheet comprising a pressure-sensitive, adhesive and waterproofing layer of a bituminous compound so that the sheet adheres to the deck over an area of 10–50% of the total sheet area and thus water vapour passing through said deck may escape laterally; said self-adhesive sheet adhering to one face of the bituminous compound, and having at least discontinuous apertures of 10–50% of the area over the sheet; applying pressure sufficient to cause flow of said bituminous compound through said apertures; and causing the self-adhesive sheet to adhere to the roof deck in the area of the apertures;

(ii) rendering the upper surface of said sheet adhesive;

(iii) applying to said adhesive upper surface of said sheet, a layer of substantially rigid and substantially non-compressible insulation and causing said insulation to adhere to said upper surface, and applying to the upper surface of said insulation a further self-adhesive sheet as defined in step (i) and rendering the upper surface of said further sheet adhesive; and (iv) applying to said adhesive surface of the sheet or said further sheet a final waterproofing sheet.

2. A method as claimed in claim 1, wherein the exposed bituminous compound in the area of the apertures is protected by a release sheet which is stripped off before application of the sheet to the roof deck.

3. A method as claimed in claim 1, wherein the upper surface of the self-adhesive sheet is protected by a thin low-melting polymer facing sheet, and the upper surface is rendered adhesive by torching.

4. A method as claimed in claim 1, wherein the roof deck surface is primed using a solution of a polymer-modified bitumen before application of the self-adhesive sheet.

5. A method as claimed in claim 1, wherein an insulation board which is expanded polystyrene is used in step (iii).

6. A method as claimed in claim 1, wherein the final waterproofing sheet is an aluminium-faced bitumen sandwich cap sheet.

7. A method of forming a waterproof roof on a roof deck, comprising the steps of (i) applying to the deck, a self-adhesive sheet comprising a pressure-sensitive, adhesive and waterproofing layer of a bituminous compound so that the sheet adheres to the deck over an area of 10–50% of the total sheet area and thus water vapour passing through said deck may escape laterally; said self-adhesive sheet ahering to one face of the bituminous compound, and having at least discontinuous apertures of 10–50% of the area of the sheet; applying pressure sufficent to cause flow of said bituminous compound through said aperatures; and causing the self-adhesive sheet to adhere to the roof deck in the area of the apertures;

(ii) rendering the upper surface of said sheet adhesive; and (iii) applying to said adhesive surface of the sheet or said further sheet a final waterproofing sheet.

* * * * *